United States Patent [19]

Natansohn

[11] Patent Number: 4,562,133

[45] Date of Patent: Dec. 31, 1985

[54] POLYMERS PHOTOCONDUCTIVE IN THE NEAR INFRA-RED

[75] Inventor: Almeria Natansohn, Ashdod, Israel

[73] Assignee: Yeda Research and Development Company Limited, Rehovot, Israel

[21] Appl. No.: 657,879

[22] Filed: Oct. 4, 1984

[30] Foreign Application Priority Data

Oct. 13, 1983 [IL] Israel ..... 69958

[51] Int. Cl.[4] ..... G03G 5/07

[52] U.S. Cl. ..... 430/80; 430/81

[58] Field of Search ..... 430/80, 81, 82

[56] References Cited

U.S. PATENT DOCUMENTS

| | | | |
|---|---|---|---|
| 3,770,428 | 11/1973 | Watarai et al. | 430/80 |
| 3,871,884 | 3/1975 | Matsumoto et al. | 430/80 |
| 4,076,526 | 2/1978 | Mulvaney et al. | 430/80 |

*Primary Examiner*—John L. Goodrow

*Attorney, Agent, or Firm*—Browdy and Neimark

[57] ABSTRACT

There are provided photoconductive compounds wherein 3-substituted N-alkyl carbazole groups and 3,5-dinitrobenzoic acid moieties are attached directly or via spacer groups to a polymeric backbone. The photoconductive compounds can be used in devices based on the photoconductivity of such compounds, such as sensors or the like, said compounds being used in the form of a film or a coating. The maximum sensitivity of such sensors is in the IR region.

11 Claims, No Drawings

POLYMERS PHOTOCONDUCTIVE IN THE NEAR INFRA-RED

FIELD OF THE INVENTION

The invention relates to novel compounds having photoconductive properties. The compounds are copolymers comprising a backbone, to which there are attached 3-substituted carbazole moieties in donors, and 3,5-dinitrobenzoic acid moieties as acceptors. The attachment is preferably via spacers, which may be hydrocarbon groups. Films or coatings prepared from such copolymers are photoconductive with a maximum in the near IR region. There are also provided devices for use in IR photography, IR sensors etc., based on such photoconductive polymer films.

STATE OF PRIOR ART

There exists a tremendous interest in polymers with photoconductive properties ever since RM Schaffert, in IBM J. Res. Dev. 15, 75 (1971) described the charge transfer complex consisting of a mixture of poly(N-vinyl carbazole) and 2,4,7-trinitro-9-fluorenone, which was used by IBM to build a photocopying machine. Despite its very good photoconductive properties, this mixture has several drawbacks: poly(N-vinyl carbazole) has a very high Tg and its films are brittle; even a 1:1 mixture with 2,4,7-trinitro-9-fluorenone reduces its Tg to only 140° C. Moreover 2,4,7-trinitro-9-fluorenone is know to produce cancer in animals.

There exist many literature references and patents dealing with other photoconductive polymers, mixtures and composites. To our knowledge, none of these has approached the qualities of the above-mentioned system. Still, the advantages of polymers instead of classical semiconducting coatings for electroimaging are very great, due to the relative ease and low cost of preparing a polymer film, avoiding the procedures of purification and maintenance. Several of the most recent patents in this field are: U.S. Pat. Nos. 4,111,850; 972,467; E.P. No. 0,063,528; E.P. No. 0,062,540 and J.P. No. 57,179,159.

Photoconductivity in the near IR is desired in IR photography, in IR sensors, etc. Organic IR photoconductors are known to be metal or metal-free phthalocyanines (R. O. Loutfy—J. Phy. Chem 86 3302 (1982); S. Grammatica and J Mort-Applied Physical Letters 38 445 (1981). Phenyl-substituted poly-p-xylylidenes which have a maximum of photoconductivity between 400 and 500 nm, were reported to present a smaller photocurrent at higher wavelength (up to 1000 nm) (H. H. Hoerhold and J. Opfermann—Makromolekulare Chemie 178 195 (1977). To our knowledge no polymer has hitherto been reported which has a peak of photoconductivity in the near IR region.

SUMMARY OF THE INVENTION

There are provided novel copolymers having a pronounced photoconductivity in the near IR region, and which can be used in film form or in the form of coatings for various uses such as IR photography, IR sensors, in photocopying machines, etc. The copolymers according to the invention comprise a hydrocarbon backbone to which there are attached 3-substituted N-alkyl carbazole moieties serving as donor groups, and 3,5-dinitrobenzoic acid moieties which serve as acceptor groups. The donor and the acceptor groups are advantageously attached via suitable spacers. Such spacers can be hydrocarbon groups of suitable length. Attachment through an acrylic bond via a suitable hydrocarbon spacer can be described by the formula:

$$\underset{\text{(Donor)}}{\text{Acceptor}}—(CH_2)_n—CO—O—\text{Backbone}$$

The ratio of donor/acceptor groups can be varied, thus modifying the properties of the resulting copolymer.

The invention further relates to a process for the production of such polymers.

The 3-substituted N-alkyl carbazole moieties are of the formula

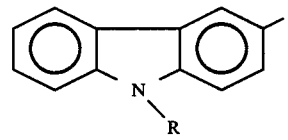

wherein R is alkyl, and the acceptor 3,5-dinitrobenzoic acid moieties are of the general formula

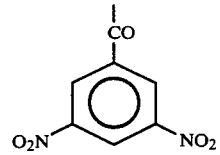

and these can be attached via suitable spacer groups, which are preferably hydrocarbon groups, to the polymeric backbone, which also is advantageously a hydrocarbon polymer.

The process of the invention comprises preparing suitable derivatives of the donor and acceptor groups, such as acryloyl derivatives of same, such as acryloyl-3-hydroxypropyl-3,5-dinitrobenzoate and N-methyl-3-hydroxymethyl carbazolyl acrylate, which are copolymerized in the presence of 2,2'-azobisisobutyronitrile.

The ratio of donor/receptor moieties can be varied within wide limits, such as 20/80 to 80/20.

The length of the spacers and the donor to acceptor ratio can be varied at will.

This type of charge-transfer complex copolymer exhibits photoconductivity when irradiated with visible light. In comparison with the best photoconductive material: poly(N-vinylcarbazole): 2,4,7-trinitro-9-fluorenone, the overall photocurrent under the same conditions is an order of magnitude lower, but the spectral response normalized for the same light intensity shows similar photocurrents, even more intense, for the photocurrent peak. The maximum photocurrent is given by poly(N-vinylcarbazole): 2,4,7-trinitro-9-fluorenone at about 475 nm, whereas the novel copolymer has a maximum at about 830 nm and still a very intense photoconductivity at above 1000 nm, i.e. in the near IR domain. The novel materials can be used as the photosensitive component of devices for IR photoimaging and in IR detectors and sensors. The advantages of organic polymeric materials instead of classical semiconductor mixtures are mainly the low cost of synthesis, avoidance of super-purification, and the possibility of easy replacement instead of maintenance services, as with classical electroimaging devices. Film properties can be varied by chemical variations in synthesis, i.e. changing the spacer length and/or the copolymer composition; one can thus obtain the desired Tg; and, also the photocurrent intensity can be varied by changing the composition, the spacer length, or by electrochemical treatment of the film. Another advantage of the novel copolymer is the fact that it is a single component and not a mixture of many components, as most of the photoconductive polymers are. Therefor, the problems of the small-molecular component properties and the tendency of mixtures to separate, dissappear.

The novel copolymers can be used in film form or in the form of coatings on a suitable substrate. They exhibit photoconductivity when irradiated with a radiation of suitable wavelength. Data on the photoconductivity of representative copolymers of the present invention are provided in the following in the enclosed Table. The novel compounds can be used in sensors, and for various applications where photoconductivity, especially in the near IR region, is required. The invention is illustrated in the following by way of example only, and the following detailed description is to be construed in a non-limitative manner.

EXAMPLES

Example 1

A. Synthesis of N-methyl-3-hydroxymethyl carbazolyl acrylate was performed in several steps: methylation of carbazole followed by formylation in the 3 position of the aromatic molecule, hydrogenation to the carboxymethyl derivative and reaction with acryloyl chloride.

N-methyl carbazole

To a vigourously stirred solution of 10 g of carbazole in 50 ml of acetone, 10 ml methyl sulphate was added, followed by dropwise addition of a solution of 10 g NaOH in 7 ml water. After a few minutes the solution was poured into water. N-methyl carbazole was purified by two ethanol recrystallization, extraction with boiling petroleum ether and another ethanol recrystallization (yield 90% m.p.=88° C.).

N-methyl-3-formyl carbazole 12 g phosphoryl chloride were added dropwise to 5.8 g N,N-dimethylformamide stirred on an ice-water bath. The mixture was allowed to reach room temperature, and then 13 g N-methyl carbazole were added in small portions. After overnight standing, the mixture was poured into water and the precipitate recrystallized from ethanol to give 90% white crystals with m.p. 77° C. IR spectrum presented the bands at 1683 $cm^{-1}$ (carbonyl) and bands characteristic to the carbazole nucleus: 719, 727, 746, 763 and 806 $cm^{-1}$. $^1$H-NMR spectrum in $CDCl_3$ had signals at 10.09 ppm (CHO, singlet), 8.60 ppm ($C_4$, doublet), 8.20–8.07 ppm ($C_2$, $C_5$ multiplet) 7.98–7.29 ppm ($C_1$, $C_6$, $C_7$, $C_8$ multiplet) and 3.90 ppm ($CH_3$, singlet).

N-methyl-3-hydroxymethyl carbazole

To a solution of 18.9 g N-methyl-3-formyl carbazole in 400 ml ethanol, a mixture of 2.5 g $NaBH_4$ and 20 ml 0.4N NaOH in water was added dropwise. The mixture was then heated at 60° C. and stirred for one hour. Cooling at room temperature, white crystals were obtained which were filtered, washed with water, dried and recrystallized from a cyclohexane:benzene mixture (1:1), yielding 92% N-methyl-3-hydroxymethyl carbazole with m.p.=96° C. IR: 3346 $cm^{-1}$ (OH), 710, 729, 747, 770, 804 $cm^{-1}$ (carbazole) $^1$H.NMR ($CDCl_3$): 8.13–8.03 ppm ($C_4$, $C_5$, multiplet) 7.43–7.29 ppm ($C_1$, $C_2$, $C_6$, $C_7$, $C_8$, multiplet) 4.84 ppm ($CH_2$ singlet) 3.83 ppm ($CH_3$ singlet) 1.64 ppm (OH, singlet).

N-methyl-3-hydroxymethyl carbazolyl acrylate (MCMA)

A mixture of 21.1 ml acryloyl chloride and 40 ml tetrahydrofuran was added dropwise during cca one hour to a stirred mixture of 42.2 g N-methyl-3-hydroxymethyl carbazole, 36 ml triethylamine and 200 ml tetrahydrofuran cooled on a ice-water bath. The resulting mixture was stirred for six more hours at room temperature, then filtered and the precipitate washed with tetrahydrofuran. The solution was evaporated to a smaller quantity and then poured into iced water. The precipitate was collected, dried and recrystallized twice from hexane, giving 72% white crystals with m.p. 56° C. IR: 1720 $cm^{-1}$ (Carbonyl), 1626 $cm^{-1}$ (double bond), 1405 $cm^{-1}$ (=CH in plane) 982 $cm^{-1}$ (=CH out of plane I), 846 $cm^{-1}$ (=CH out of plane II) 711, 725, 745, 765, 806 $cm^{-1}$ (carbazole)-$^1$H-NMR ($CDCl_3$): 8.10–8.04 ppm ($C_4$, $C_5$, multiplet), 7.56–7.30 ppm ($C_1$, $C_2$, $C_6$, $C_7$, $C_8$, multiplet), 6.57–5.73 ppm ($CH{=}CH_2$, multiplet), 5.38 ppm ($CH_2$, singlet) 3.83 ppm ($CH_3$, singlet).

B. Synthesis of acryloyl-ω-hydroxy-n-alkyl-3,5-dinitrobenzoate was performed in two steps: esterification of 3,5-dinitrobenzoic acid with n-alkyl-α, ω-diol followed by the reaction with acryloyl chloride.

3-hydroxypropyl-3,5-dinitrobenzoate

A mixture of 30 g 3,5-dinitrobenzoic acid, 0.8 g p-toluenesulfonic acid and 100 ml 1,3-propanediol was stirred 9 hours at 110° C. After cooling, a white product crystallized and was separated from solution by filtration after adding a large quantity of water. The product was recrystallized from methanol to provide 77% white crystals with m.p. 76° C. IR: 1712 $cm^{-1}$ (carbozyl) 1535 $cm^{-1}$ (nitro asymmetric), 1341 $cm^{-1}$ (nitro symmetric). $^1$H-NMR ($DMSOd_6$): 9.05 ppm ($C_4$), 8.93 ppm ($C_2$, $C_6$), 4.47 ppm ($CH_2OCO$, triplet) 3.62 ppm ($CH_2O$, triplet), 1.94 ppm ($CH_2$ multiplet).

Acryloyl-3-hydroxypropyl-3,5-dinitro benzoate (DNBPA)

A mixture of 7.8 ml acryloyl chloride and 15 ml tetrahydrofuran was added dropwise during half an hour strong stirring to a solution of 20 g 3-hydroxypropyl-3,5-dinitrobenzoate and 13.3 ml triethylamine in 100 ml tetrahydrofuran cooled on an ice-water bath. After stirring one more hour at 0° C. and six hours at room temperature the solution was filtered, the precipitate washed with tetrahydrofuran, and the filtrate concentrated on a rotovapour at room temperature, then poured into iced water. The oil layer was extracted with ether, washed with $NaHCO_3$ aqueous solution, water, dried on $CaCl_2$ and chromatographied on alumina with ethylic ether as eluent. The final product was obtained after ether evaporation as an oil (75%). IR: 1705 $cm^{-1}$ (carbazyl), 1612 $cm^{-1}$ (double bond) 1525 $cm^{-1}$ (nitro assymmetric), 1335 $cm^{-1}$ (nitro symmetric). $^1$H-NMR ($CDCl_3$): 9.23 ppm ($C_4$), 9.16 ppm ($C_2$, $C_6$), 6.54–5.76 ppm ($CH{=}CH_2$), 4.58 ppm ($CH_2$, triplet), 4.36 ppm ($CH_2$, triplet), 2.25 ppm ($CH_2$, multiplet).

C. 3.5 ml 0.5M solution of MCMA in dry toluene was poured together with 3.5 ml 0.5M solution of DNBPA in dry toluene into an ampoule which contained 0.0103 g 2,2'-azobisisobutyronitrile. After bubbling through dry argon, long enough to eliminate all the air, the ampoule was sealed and heated at 60° C. for 144 hours. The ampoule was opened and the resulting mixture dissolved in tetrahydrofuran and poured into acidified (HCl) methanol. The orange copolymer was purified by reprecipitation from tetrahydrofuran (solvent): methanol (nonsolvent) pair and a yield of 24.6% was obtained. Copolymer composition determined by NMR showed a ratio of 55% structural units of MCMA to 45% structural units DNBPA. Copolymer Tg was 93° C.

Example 2

A. MCMA was synthesized as in Example 1.

B. 4'-hydroxybutyl 1-3,5-dinitrobenzoate

This was synthesized by the same method as 3'-hydroxypropyl-3,5-dinitrobenzoate (Example 1), from 33.4 g 3,5-dinitrobenzoic acid, 1.3 g p-toluenesulfonic acid and 150 g 1,4-butanediol, the yield was 67% of white crystals, m.p.=97° C.

IR: 1718 $cm^{-1}$ (carbonyl), 1530 $cm^{-1}$ (nitro assymmetric), 1341 $cm^{-1}$ (nitro symmetric). $^1$H-NMR ($DMSOd_6$): 9.05 ppm ($C_4$), 8.93 ppm ($C_2$, $C_6$), 4.47 ppm ($CH_2OCO$, triplet) 3.42 ppm ($CH_2O$ triplet) 1.71 ($CH_2$, multiplet).

Acryloyl-4'-hydroxybutyl-3,5-dinitrobenzoate (DNBBA)

Synthesis was similar to that of DNBPA (Example 1), from 7.4 ml acryloyl chloride in 15 ml tetrahydrofuran, added to 20 g 4'-hydroxybutyl-3,5-dinitrobenzoate and 12.6 ml triethylamine in 200 ml tetrahydrofuran, DNBBA was obtained as white crystals with 80% yield after recrystallization from methanol (m.p. 47° C.). IR: 1710 $cm^{-1}$ (cabonyl), 1615 $cm^{-1}$ (double bond), 1535 $cm^{-1}$ (nitro assymmetric), 1338 $cm^{-1}$ (nitro symmetric). $^1$H-NMR ($CDCl_3$): 9.20 ppm ($C_4$), 9.16 ppm ($C_2$, $C_6$), 6.58–5.75 ppm ($CH{=}CH_2$), 4.51 ppm ($CH_2$ triplet), 4.26 ppm ($CH_2$ triplet) 1.95 ppm ($CH_2$ multiplet)

C. 3.5 ml 0.5M solution of MCMA in dry toluene was poured together with 3.5 ml 0.5M solution of DNBBA in dry toluene into an ampoule which contained 0.0106 g 2,2'-azo bis isobutyronitrile. After bubbling through dry argon long enough to eliminate all the air, the ampoule was sealed and heated to 60° C. for 120 hours. The purification procedure is identical to that given in Example 1, yielding 22.3% of an orange copolymer with a composition determined by NMR.

The copolymer Tg was 78° C.

Example 3

A. MCMA was synthesized as in Example 1.

B. DNBPA was synthesized as in Example 1.

C. Copolymerization was performed as in Example 1, using 6 ml of a 0.5M solution of MCMA and 3 ml of a 0.5M solution of DNBPA with 0.0144 g AIBN for 150 hours. The orange copolymer contained 67% MCMA units and 33% DNBPA units and had a Tg of 103° C.

Example 4

A. MCMA was synthesized as in Example 1.

B. DNBPA was synthesized as in Example 1.

C. Copolymerization was performed as in Example 1, using 21 ml of a 0.5M solution of MCMA and 4.9 ml of a 0.5M solution of DNBPA and 0.0107 g AIBN. After 132 hours, an orange copolymer containing 41% MCMA units and 59% DNBPA units was obtained. Tg 83° C.; (20.4% yield)

Example 5

A. MCMA was obtained as in Example 1.

B. DNBPA was obtained as in Example 1.

C. Copolymerization was performed as in Example 1, using 4.0 ml 0.5M solution of MCMA and 5.1 ml 0.5M solution of DNBPA and 0.0133 g AIBN for 140 hours. The orange copolymer contained 50% MCMA units and 50% DNBA units and had a Tg of 99° C. (25.8% yield).

Example 6

A. MCMA was obtained as in Example 1.

B. 7 ml of 0.5M solution in dry toluene was poured into an ampoule containing 0.0093 g 2,2'-azo-bis isobutyzonitrile was bubbled through, the ampoule was then sealed and allowed to stay for 34 hours at 60° C. The obtained polymer was dissolved in chloroform and precipitated and reprecipitated from acidic methanol to yield 92.2% white powder with a Tg of 109° C.

Example 7

A chloroform solution of the copolymer obtained in Example 1 was spin-coated on a piece of conductive quartz (commercially available quartz with an indium oxide coated surface), and then the piece of quartz was used as a positive electrode in an electrochemical cell containing dry acetonitrile and 0.1M $LiClO_4$ as electrolyte. A 200 $\mu$A current was passed through the cell for three minutes. The coated surface of the copolymer changed its color from yellow to green.

Photoconductive Properties

Photoconductive properties of the novel copolymers were determined by the standard Time-of-Flight Method, as described in "Poly(N-vinyl Carbazole" by J. M. Peasron and M. Stolka, Gordon and Breach Science Publishers, New York, 1981.

Films on conductive quartz were obtained by spin coating chloroform solutions, as described in Example 7. A gold electrode was evaporated on the film, and the photocurrent was measured on a lock-in amplifier using a tungsten-halogen lamp as a chopped light source and several filters cutting off different wavelengths domains. Light intensity was subsequently normalized for the same value all over the spectral range using a calibrated silicone cell. The table shows the results in terms both of maximum photocurrent and corresponding photoresistivity and of normalized photocurrents and corresponding photoresistivity. For comparison, a film of the well-known mixture of poly(N-vinilcarbazole):2,4,7-trinitro-9-fluorenone (1:1) was prepared in a similar manner and subjected to photoconductivity measurements under the same conditons. Analysing the figures in the Table, it is obvious that for the same light intensity, the novel copolymers have a photoresistivity comparable to, and sometimes even lower than that of poly(N-vinyl carbazole):2,4,7-trinitro-9-fluorenone mixture. The photoresistivity is affected by the chemical structure (ratio donor: acceptor, spacer length, electrochemical oxidation).

TABLE

| Example No. | Film thickness (μm) | Total Photocurrent (nA) | Voltage bias (mV) | Photoressitivity (Ω · cm) × $10^{-9}$ | Maximum normalized photocurrent (nA/watt) | Wavelength (nm) of maximum photocurrent | Percent photo-current above 1000 nm |
|---|---|---|---|---|---|---|---|
| | | Photoconductive properties | | | | | |
| 1 | 0.6 | 1.00 | 2 | 100 | 21.9 | 830 | 45 |
| 2 | 0.6 | 1.60 | 2 | 69 | 35.3 | 830 | 50 |
| 3 | 0.9 | 2.25 | 2 | 31 | 44.2 | 830 | 36 |
| 4 | 0.8 | 0.44 | 2 | 180 | 9.6 | 830 | 43 |
| 5 | 0.9 | 4.10 | 20 | 170 | 200.0 | 830 | 46 |
| 6 | 0.7 | 0.67 | 2 | 140 | 0.8 | <475 | 0 |
| 7 | 0.8 | 2.30 | 2 | 35 | 43.5 | 830 | 57 |
| poly(N—vinyl-carbazole) 2,4,7-trinito-9-fluorenone (1:1) (comparison) | 1.3 | 62.0 | 20 | 8 | 285.3 | 475 | 0 |

I claim:

1. A photoconductive compound being a copolymer having a maximum photocurrent in the near IR region and comprising a polymeric backbone to which there are attached 3-substituted N-alkyl carbazole groups and 3,5-dinitrobenzoic acid moieties, the attachment of said moieties being directly or via suitable spacer moieties.

2. A photoconductive copolymer according to claim 1 wherein the 3-substituted N-alkyl carbazole group is of the formula

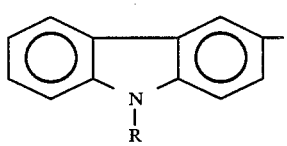

wherein R is lower alkyl.

3. A photoconductive copolymer according to claim 1, wherein the 3,5-dinitrobenzoic acid moiety is of the formula

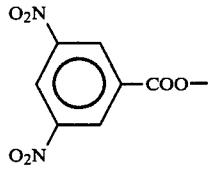

4. A photoconductive copolymer according to any of claim 1, wherein the polymeric backbone is selected from $$-(CH_2)_x-\underset{|}{CH}- \quad -(CH^2)_x-\overset{CH_3}{\overset{|}{\underset{|}{C}}}- \text{ wherein x is 1 to 7.}$$

5. A photoconductive copolymer according to claim 1, wherein the moieties attached to the backbone are attached via spacing moieties selected from $-(CH_2)_n-O-CO$ wherein n is 1 to 6.

6. A photoconductive copolymer according to claim 1, wherein the ratio of the attached moieties is from 20 to 80 and up to 80 to 20.

7. A copolymer according to claim 1, wherein from 29.6 to 1.6 mmoles of carbazole and about 29.6 to 1.6 mmoles dinitrobenzoic acid moieties are attached per gram of polymeric backbone.

8. A sensor or other device based on a photoconductive material, having sensitivity in the IR region, based on a film or coating of a substance claimed in claim 1.

9. A photoconductive compound being a copolymer having a maximum photocurrent in the near IR region and comprising a polymeric backbone to which there are attached 3-substituted N-alkyl carbazole groups and 3,5-dinitrobenzoic acid moieties, the attachment of said moieties being directly or via suitable spacer moieties, and the carbazole groups being so attached via a carbon atom of the carbazole ring.

10. A photoconductive copolymer according to claim 9 which is the reaction product of N-methyl-3-hydroxymethyl carbazolyl acrylate and a 3,5-dinitrobenzoate selected from the group consisting of acryloyl-3-hydroxypropyl-3,5-dinitrobenzoate and acryloyl-4'-hydroxybutyl-3,5-dinitrobenzoate.

11. A photoconductive copolymer according to claim 9 having a maximum photocurrent on the order of about 830 nm.

* * * * *